US009616663B2

(12) United States Patent
Itoh et al.

(10) Patent No.: US 9,616,663 B2
(45) Date of Patent: Apr. 11, 2017

(54) LIQUID EJECTING HEAD

(71) Applicant: CANON KABUSHIKI KAISHA, Tokyo (JP)

(72) Inventors: Yoshinori Itoh, Tokyo (JP); Nobuhito Yamaguchi, Inagi (JP); Hiroshi Arimizu, Kawasaki (JP); Yusuke Imahashi, Kawasaki (JP); Arihito Miyakoshi, Tokyo (JP); Masahiko Kubota, Tokyo (JP); Koichi Ishida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/996,657

(22) Filed: Jan. 15, 2016

(65) Prior Publication Data

US 2016/0207309 A1 Jul. 21, 2016

(30) Foreign Application Priority Data

Jan. 19, 2015 (JP) ..... 2015-007596

(51) Int. Cl.
*B41J 2/14* (2006.01)

(52) U.S. Cl.
CPC ..... *B41J 2/14032* (2013.01); *B41J 2/14016* (2013.01); *B41J 2/14072* (2013.01); *B41J 2/14129* (2013.01); *B41J 2/14* (2013.01)

(58) Field of Classification Search
CPC ..... B41J 2/14032; B41J 2/14016; B41J 2/14; B41J 2002/14491; B41J 2/14129; B41J 2/14072
See application file for complete search history.

(56) References Cited

U.S. PATENT DOCUMENTS 6,609,783 B1 8/2003 Koyama et al.
2006/0033780 A1* 2/2006 Ono ..... B41J 2/14072 347/59
2006/0221141 A1* 10/2006 Parish ..... B41J 2/14072 347/63

FOREIGN PATENT DOCUMENTS

JP 06-155755 A 6/1994
JP 2011-088103 A 5/2011

* cited by examiner

*Primary Examiner* — Manish S Shah
*Assistant Examiner* — Yaovi M Ameh
(74) *Attorney, Agent, or Firm* — Fitzpatrick, Cella, Harper & Scinto

(57) ABSTRACT

Adhesion of particles to a liquid ejecting head due to an electric field generated at an electric power supply wire disposed in the liquid ejecting head can be suppressed. The liquid ejecting head is provided with a conductive member covering at least a part of the electric power supply wire for supplying electric power to an ejection energy generating unit configured to generate ejection energy for ejecting liquid, with an insulator therebetween. The conductive member covers the electric power supply wire in a coverage determined based on a relative movement speed between an ejection port and a print medium, a size of particles floating between an ejection port forming surface and the print medium, an electric charge amount of the particles, and a voltage applied to the electric power supply wire.

9 Claims, 11 Drawing Sheets

LIQUID EJECTING HEAD

BACKGROUND OF THE INVENTION

Field of the Invention

The present invention relates to a liquid ejecting head for ejecting liquid through an ejection port.

Description of the Related Art

As a printing apparatus for performing printing on a print medium or the like that is widely used at present, an ink jet printing apparatus ejects liquid such as ink from a liquid ejecting head in the form of droplets and lands it on a print medium to form an image or the like. Such an ink jet printing apparatus ejects a fine particulate droplet called ink mist through each of a plurality of ejection ports formed at each of liquid ejecting heads besides droplets (main droplets) landing on a print medium to form an image. After this ink mist is ejected from each of the liquid ejecting heads, the ink mist may float inside of the ink jet printing apparatus without landing on the print medium, and then, adhere to the liquid ejecting head, thereby degrading the function of the liquid ejecting head or shortening the lifetime thereof. In particular, in a case where a large quantity of ink mist adheres onto the liquid ejecting head to coalesce into a large ink droplet, the coalescent ink droplet closes an ejection port, thus raising a problem that deficient ejection is induced to degrade the quality of an image.

In view of the problem, Japanese Patent Laid-Open No. 2011-88103 discloses the configuration in which a suction port arranged outside of a liquid ejecting head sucks air to suck and recover ink mist together with the air.

In addition, Japanese Patent Laid-Open No. H06-155755 (1994) discloses forming a conductive thin film on a liquid ejecting head and grounding it, and then, releasing static electricity generated on a nozzle plate via the conductive thin film so as to avoid an ink droplet from being sucked by or adhering onto the nozzle plate. In other words, Japanese Patent Laid-Open No. H06-155755(1994) discloses the technique for forming a conductive thin film at a frictionally sliding surface and grounding it on the understanding that ink mist is adsorbed by static electricity generated by slide friction between the surface of a liquid ejecting head and a wiper member.

However, the techniques disclosed in Japanese Patent Laid-Open No. 2011-88103 and Japanese Patent Laid-Open No. H06-155755(1994) cannot satisfactorily suppress the adhesion of ink mist or dust onto the liquid ejecting head under present circumstances. Specifically, the technique disclosed in Japanese Patent Laid-Open No. 2011-88103 can recover ink mist or dust flowing outward of the surroundings of the liquid ejecting head. However, ink mist or dust produced between the liquid ejecting head and a print medium adheres to an ejection port forming surface of the liquid ejecting head before flowing outward of the surroundings of the liquid ejecting head, thereby inducing contamination of the ejection port forming surface or degrading ejection performance.

Moreover, the technique disclosed in Japanese Patent Laid-Open No. H06-155755(1994) can suppress adhesion of ink mist or dust onto the nozzle plate of the liquid ejecting head whereas it cannot suppress adhesion of ink mist or dust to portions other than the surface of the nozzle plate of the liquid ejecting head. As a consequence, ink mist or dust adhering to the portions other than the surface of the nozzle plate causes contamination or reduced lifetime of the liquid ejecting head.

SUMMARY OF THE INVENTION

An object of the present invention is to provide a liquid ejecting head capable of alleviating the adhesion of a particle to the liquid ejecting head. According to the present invention, a liquid ejecting head that ejects liquid through an ejection port includes: an electric power supply wire configured to supply electric power to an ejection energy generating unit configured to generate ejection energy for ejecting liquid through the ejection port; and a conductive member configured to cover at least a part of the electric power supply wire via an insulator, wherein the conductive member covers the electric power supply wire in a coverage determined based on a relative movement speed between the ejection port and a print medium, a size of a particle floating between an ejection port forming surface having the ejection port formed thereat and the print medium, an electric charge amount of the particle, and a voltage applied to the electric power supply wire.

According to the present invention, a liquid ejecting head provided with an ejection port that makes a relative movement with respect to a print medium while ejecting liquid onto the print medium includes: an electric power supply wire configured to supply electric power to an ejection energy generating unit configured to generate ejection energy for ejecting liquid through the ejection port; and a conductive member configured to cover at least a part of the electric power supply wire via an insulator, wherein the coverage of the conductive member with respect to the electric power supply wire is determined according to the following formula:

$$\text{Coverage} \geq 1-(3\times(D)\times10^{-18})/|(Q)|\times(U)^2/(V)$$

where U (inch/second) represents a relative movement speed between the ejection port and the print medium; V (V), a voltage applied to the electric power supply wire; D (μm), a size of a particle that is ejected through the ejection port and floats between an ejection port forming surface having the ejection port formed thereat and the print medium; and Q (C), an electric charge amount possessed by the particle.

According to the present invention, the electric field produced at the electric power supply wire is shut by the conductive member, and therefore, it is possible to alleviate the adhesion of a fine liquid droplet or a particle such as dust to the liquid ejecting head. Consequently, it is possible to reduce the degradation of ejection performance caused by closing the ejection port with the liquid droplet or dust and the deterioration of a quality of an image, and furthermore, suppress contamination or reduced lifetime of the liquid ejecting head.

Further features of the present invention will become apparent from the following description of exemplary embodiments (with reference to the attached drawings).

DESCRIPTION OF THE EMBODIMENTS

In a case where a liquid ejecting head for ejecting liquid such as ink ejects ink through an ejection port, the liquid ejecting head ejects a main droplet, fine satellites (droplets) concomitant therewith, and atomized ink mist finer than the satellites. The present inventors gained findings from experiments that in an ink jet printing apparatus, a principle mechanism in which particles such as ink mist or dust adhere to a liquid ejecting head is caused by the interaction between the transportation of the ink mist along an air flow and the attractive force of an electric field produced at an electric power supply wire. In view of this, explanation will be first made on the mechanism of the adhesion of the ink mist or dust onto the liquid ejecting head.

Figure 1:
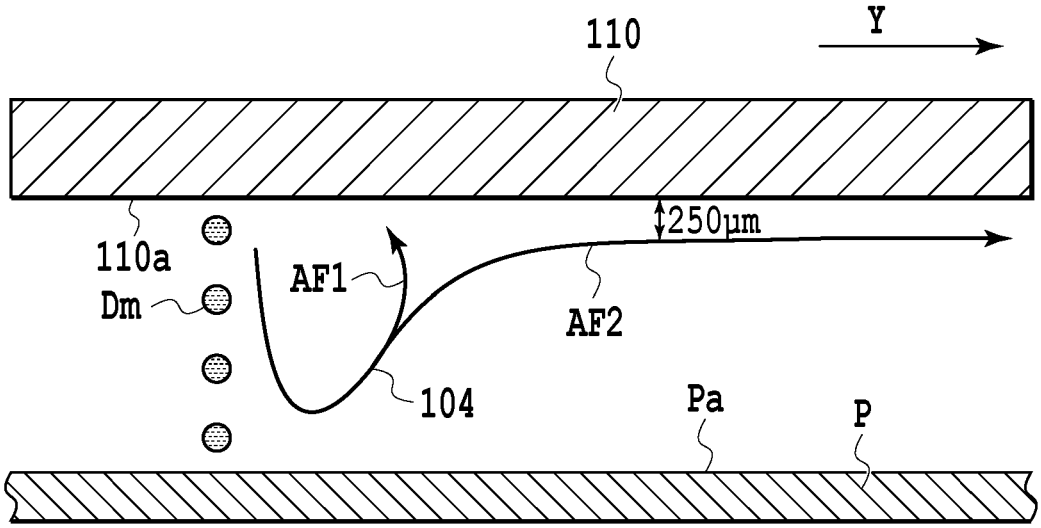
FIG. 1 is a side view showing the behavior of ink mist ejected from a liquid ejecting head.

FIG. 1 is a side view showing the behavior of a liquid droplet (i.e., an ink droplet) ejected from a liquid ejecting head during a printing operation. In a case where an ink droplet is ejected through an ejection port of a liquid ejecting head 110, fine liquid droplets (i.e., ink mist) floating between a surface (a lower surface in FIG. 1) 110*a* of the liquid ejecting head 110 and a print medium P are produced besides the ink droplet (i.e., a main droplet) Dm landing on the print medium P. Such ink mist flows toward the surface (i.e., an ejection port forming surface) 110*a* of the liquid ejecting head 110 along an upward air flow AF1, as shown in FIG. 1. Furthermore, a part of the ink mist is transported downstream in a conveyance direction from the liquid ejecting head 110 along an air flow AF2 in the conveyance direction (i.e., a Y direction) of the print medium P. At this time, it was found by an air flow simulation for analyzing a Navier-Stokes equation by a finite volume method that the ink mist approaches a position apart by about 250 μm from the ejection port forming surface 110*a* of the liquid ejecting head 110 under a typical print condition.

In this manner, electrically charged particles such as ink mist or dust (such as paper powder) transported up to the vicinity of the ejection port forming surface 110*a* of the liquid ejecting head 110 along the air flow adheres to the ejection port forming surface 110*a* by an attractive force due to an electric field produced at an electric power supply wire. Since the electric power supply wire is adapted to supply electric power to an ejection energy generating unit disposed in the vicinity of an ejection port so as to eject ink through the ejection port, the electric power supply wire is disposed near the ejection port. As a consequence, the ink mist adhering onto the liquid ejecting head by the above-described attractive force due to the electric field may mainly cause deficient ejection of the ink droplet through the ejection port. In view of this, a region in which the electric power supply wire serving as at least an electric field generating source is formed is covered with a conductive member via an insulator, thus effectively suppressing the adhesion of the ink mist to the ejection port forming surface 110*a* of the liquid ejecting head 110.

Hereinafter, a description will be given of the further specific configuration of a liquid ejecting head according to the present invention by way of embodiments below. Here, the description will be given below by way of an ink jet print head for use in an ink jet printing apparatus for ejecting an ink droplet toward a print medium so as to form an image.

First Embodiment

Figure 2:
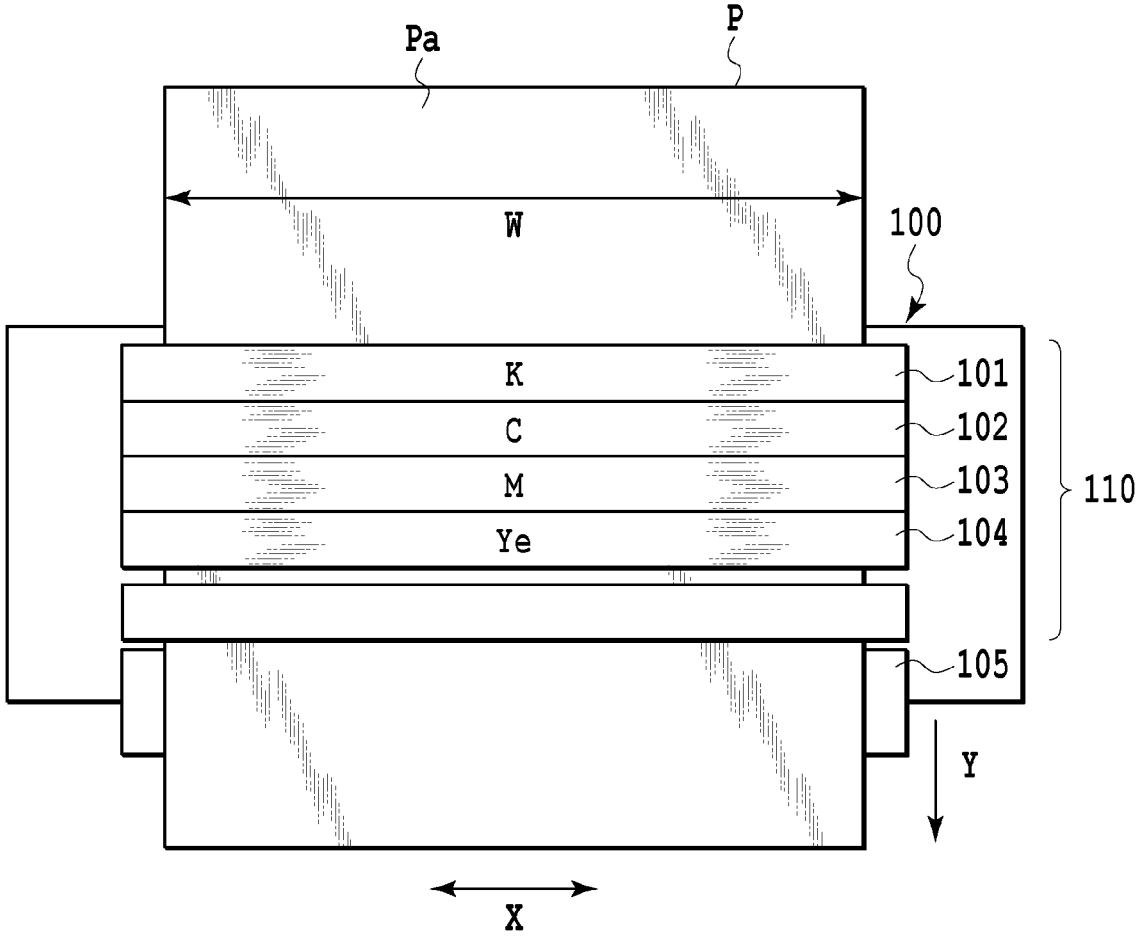
FIG. 2 is a plan view schematically showing an ink jet printing apparatus according to one embodiment of the present invention.

FIG. 2 is a view schematically showing an ink jet printing apparatus (hereinafter simply referred to as a printing apparatus) using a liquid ejecting head according to the present invention. As shown in FIG. 2, a printing apparatus 100 has a configuration in which liquid ejecting heads 101 to 104 are mounted on a frame forming a skeletal outline therefor. The liquid ejecting heads 101 to 104 each have ejection ports, through which black (K), cyan (C), magenta (M), and yellow (Ye) inks (i.e., liquids) are ejected. Each of the liquid ejecting heads has an elongate configuration in which a plurality of ejection ports are arrayed in a predetermined density over a range equal to or greater than a width W of the print medium P in a direction (i.e., an X direction) perpendicular to the conveyance direction (i.e., the Y direction) of the print medium P. A printing apparatus for performing printing by using the elongate liquid ejecting head is typically called a full line type printing apparatus. Incidentally, in the following description, in a case where the liquid ejecting heads do not need to be distinguished from each other, all of the liquid ejecting heads are collectively referred to as the liquid ejecting head 110.

A conveyance roller 105 (and other rollers, not shown) is rotated by the drive force of a motor, not shown, so that the print medium P is conveyed in the conveyance direction (i.e., the Y direction). While the print medium P is conveyed, ink droplets are ejected through a plurality of ejection ports formed at each of the liquid ejecting heads 101 to 104 according to print data. Consequently, images of one raster corresponding to an ejection port array of each of the liquid ejecting heads are formed in sequence. In this manner, the ink droplets are ejected from each of the liquid ejecting heads to the print medium P that is sequentially conveyed, and consequently, a color image of, for example, one page is printed. Incidentally, the liquid ejecting head 110, to which the present invention is applicable, is not limited to a liquid ejecting head in the above-described full line type printing apparatus. For example, the present invention is applicable to a liquid ejecting head for use in a so-called serial type printing apparatus that performs printing by moving liquid ejecting heads in a direction crossing a conveyance direction of a print medium P.

Figure 3A:
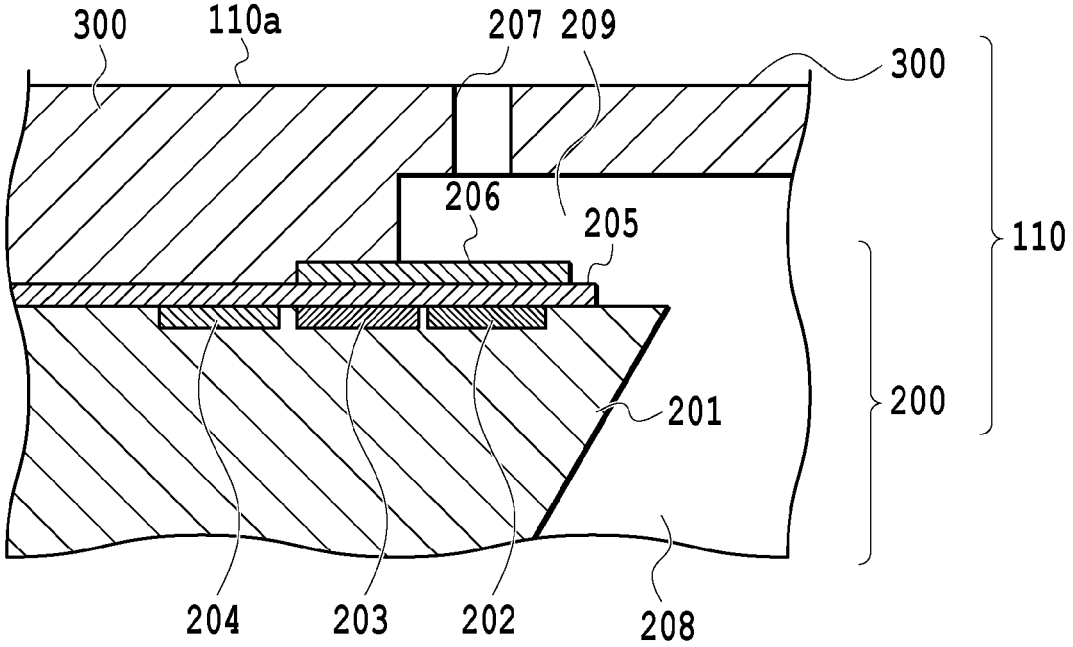
FIG. 3A is a view showing the configuration of a liquid ejecting head in the embodiment of the present invention.
Figure 3B:
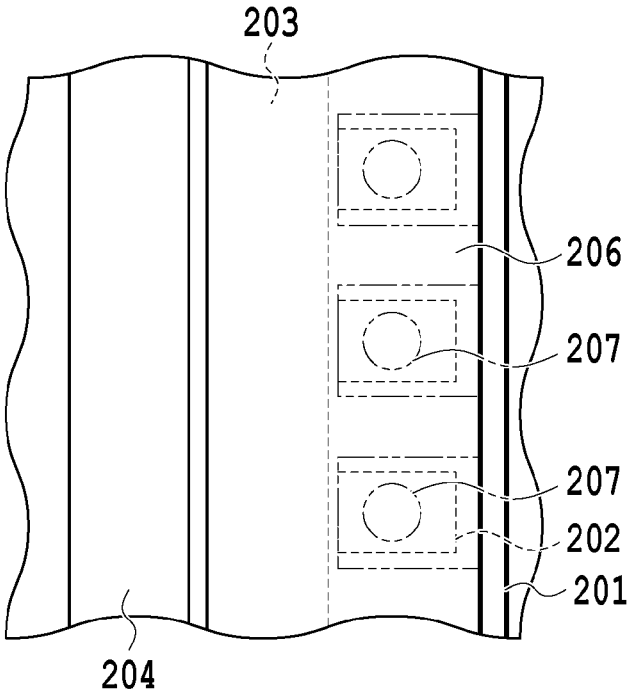
FIG. 3B is a partial plan view of FIG. 3A.

FIGS. 3A and 3B are views showing the inside configuration of the liquid ejecting head in the present embodiment, wherein FIG. 3A is a cross-sectional view, and FIG. 3B is a plan view showing a substrate for the liquid ejecting head shown in FIG. 3A. In FIGS. 3A and 3B, the liquid ejecting head 110 in the present embodiment includes a substrate 200 and an ejection port forming member 300 bonded over the surface of the substrate 200.

An ejection port 207, through which liquid is ejected, is formed in the ejection port forming member 300. A liquid chamber 209 communicating with the ejection port 207 is defined between the ejection port forming member 300 and the substrate 200. Liquid is supplied from a liquid supply source such as an exterior liquid reservoir tank through a liquid supply port 208 formed in the substrate 200.

In the meantime, the substrate 200 is provided with a base 201 and an ejection energy generating unit 202, an electric power supply wire 203, and a ground wire 204 that are embedded at the surface of the base 201 (i.e., an upper surface in FIG. 3A). In the present embodiment, the base 201 is made of silicon. Moreover, the ejection energy generating unit 202 in the present embodiment includes a heater serving as an electrothermal transducer at a position at which the heater faces the ejection port 207.

An electric insulating layer 205 is laminated on the substrate 200 in the present embodiment to cover the entire surfaces of the heater 202, the electric power supply wire 203, and the ground wire 204 and a part of the surface of the base 201. At the surface (i.e., an upper surface in FIG. 3A) of the insulating layer 205, a region facing a region in which the electric power supply wire 203 is formed is covered with a conductive layer (i.e., a conductive member) 206 in a predetermined coverage. The coverage of the conductive layer 206 is set according to a formula, described later. Incidentally, in a case where a plurality of electric power supply wires 203 are formed adjacent to each other, a minimum and single region encompassing the plurality of electric power supply wires 203 is referred to as a region in which the electric power supply wires are formed. The conductive layer 206 is formed in the region of the insulating layer 205 facing the region in a predetermined coverage. FIG. 3B shows a state in which the insulating layer 205 serving as an insulator covering the electric power supply wire 203, the ground wire 204, and the heater 202 and the ejection port forming member 300 are omitted in order to clearly grasp the positions of the electric power supply wire 203, the ground wire 204, and the heater 202.

In the liquid ejecting head such configured as described above, the ejection port forming member 300 was made of a resin in the present embodiment. Moreover, the insulating layer 205 for electrically insulating the electric power supply wire 203 and the conductive layer 206 from each other was made of a silicon nitride film. Here, the insulating layer 205 may be made of other insulating materials such as silicon dioxide and silicon carbide.

Additionally, the conductive layer 206 in the present embodiment is designed to be laminated on the insulating layer 205 to cover not only a region facing the electric power supply wire 203 but also a region facing the heater 202, and thus, has both of an electric field shutting function, described later, and a function as a protective film layer for protecting the heater 202. As a consequence, the conductive layer 206 is made of metal excellent in corrosion resistance to satisfactorily protect the heater 202 from corrosion caused by ink. Tantalum is used in the present embodiment. Incidentally, a conductive layer may be formed independently of a protective film layer for protecting the heater 202.

Next, explanation will be made on a method for determining a minimum coverage in which the electric power supply wire 203 needs to be covered with the conductive layer 206. An air flow between the liquid ejecting head 110 and the print medium P and an electric filed caused by the electric power supply wire 203 were found by simulation which analyzes the Navier-Stokes equations and the Maxwell-Gauss equations by using the finite volume method, resulting in the minimum coverage. Parameters for the simulation included a coverage of the conductive layer 206 over the formation region of the electric power supply wire 203, a voltage applied to the electric power supply wire 203, an electric charge amount of ink mist, a particle size of ink mist, and a relative movement speed between the liquid ejecting head 110 and the print medium P. Print experiments were carried out based on the set parameters, to analyze an effect in suppressing the adhesion of ink mist or the like due to the electric field caused by the electric power supply wire.

As a result, it was found that the coverage needs to satisfy the relationship determined by Formula 1 below so as to suppress the adhesion of the ink mist to the ejection port forming surface 110*a* of the liquid ejecting head 110.

$$\text{Coverage} \geq 1-(3\times(D)\times10^{-18})/|(Q)|\times(U)^2/(V) \qquad \text{Formula 1}$$

In Formula 1, U represents a relative movement speed (inch/second) between the liquid ejecting head and the print medium; V, a voltage (V) applied to the electric power supply wire; D, a particle size (μm) of the ink mist; and Q, an electric charge amount (C) possessed by the ink mist.

In the present embodiment, the conductive layer 206 covers the region of the insulating layer 205 facing the region in which the electric power supply wire 203 is formed so as to satisfy the relationship expressed by Formula 1.

Print experiments were carried out for checking an effect in suppressing the adhesion of the ink mist or the like to the liquid ejecting head 110 in the present embodiment such configured as described above. The print experiments carried out on a liquid ejecting head (a head A), in which the coverage of the conductive layer 206 covering the electric power supply wire 203 was 0.64, and another liquid ejecting head (a head B), in which the coverage of the conductive layer 206 was 0.95. The experiments were carried out under conditions where a voltage of 24 (V) was applied to the electric power supply wire 203 of each of the heads A and B, and furthermore, where a relative movement speed between each of the heads A and B and the print medium P was 33 (inch/second).

The experimental results are as follows.

In the case of the use of the head A in which the coverage of the conductive layer 206 covering the electric power supply wire 203 was 0.64, it was confirmed that the ink mist selectively adhered to the region of the ejection port forming surface 110*a* of the head A facing the formation region of the electric power supply wire 203. As the print operation was continued, the selectively adhering ink mist was coalesced together at the ejection port forming surface 110*a* facing the formation region of the electric power supply wire 203 to become a large ink droplet that closed the ejection port 207, thereby inducing deficient ejection.

In contrast, in the case of the use of the head B in which the coverage of the conductive layer 206 covering the electric power supply wire 203 was 0.95, the adhesion of the ink mist to the region in which the electric power supply wire 203 was formed was suppressed. Even if the print operation was continued like in the case of the use of the head A, the ink mist did not close the ejection port 207, resulting in no deficient ejection.

Subsequently, the experimental results are discussed.

Figure 4:
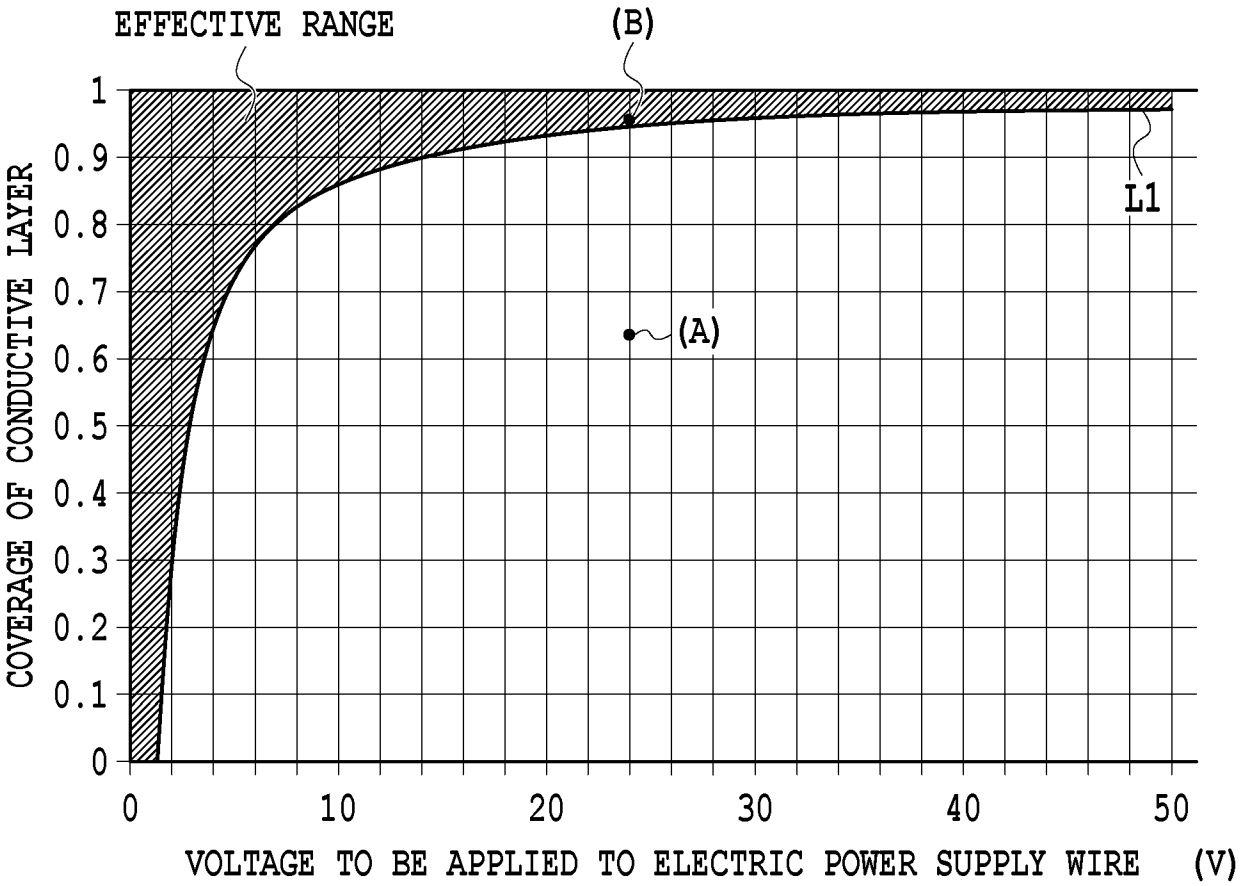
FIG. 4 is a graph illustrating the relationship between a voltage applied to an electric power supply wire and the coverage of a conductive layer in a first embodiment.

In general, the ink mist adhering to the liquid ejecting head has a particle size of about 2 (μm) and an electric charge amount of about $-5\times10^{-15}$ (C). In view of this, on the assumption of ink mist having a particle size of 2 (μm) and an electric charge amount of $-5\times10^{-15}$ (C), a curve L1 in FIG. 4 shows an example of the relationship between a "voltage to be applied to electric power supply wire" and a "minimum coverage of conductive layer" obtained according to Formula 1. In the example in FIG. 4, the relative movement speed between the liquid ejecting head 110 and the print medium P was 33 (inch/second). Here, a "minimum coverage of conductive layer" indicated by the curve L1 is defined as follows: the "minimum coverage of conductive layer" signifies a minimum value among ratios (coverages) of the conductive layer 206 that covers the region in which the electric power supply wire 203 is formed via the insulating layer 205, the ratios achieving an effect in suppressing the adhesion of the ink mist or the like to the liquid ejecting head 110.

A shaded range in FIG. 4 indicates coverages that are equal to or greater than a minimum coverage corresponding to a voltage to be applied to the electric power supply wire 203, that is, indicates a range (an effective range) in which the adhesion of the ink mist to the ejection port forming surface 110*a* can be suppressed. As a consequence, even if the print operation is continuously performed with the liquid ejecting head 110 in which the coverage of the conductive layer 206 with respect to the electric power supply wire 203 falls within the shaded region, it is possible to suppress deficient ejection that is caused by the adhesion of the ink mist.

Moreover, in FIG. 4, (A) shows the coverage in the case of the head A used in the above-described experiments, whereas (B) shows the coverage in the case of the head B. As illustrated in FIG. 4, it is found that: the coverage in the case of the head A in which the adhesion suppression effect of the ink mist could not be achieved in the above-described experiments falls under the curve L1; in contrast, the coverage in the case of the head B in which the satisfactory adhesion suppression effect of the ink mist could be achieved falls on and above the curve L1. As a result, whether or not the adhesion of the ink mist or the like can be suppressed in the liquid ejecting head 110 depends upon whether or not the coverage of the conductive layer 206 falls on or above the curve L1 obtained according to Formula 1. In other words, the adhesion suppression effect of the ink mist or the like in the liquid ejecting head 110 can be determined by comparing the coverage of the conductive layer with respect to the electric power supply wire 203 with the curve L1 even without any experiments.

Furthermore, the minimum coverage of the conductive layer 206 is obtained according to Formula 1 above, and then, the electric power supply wire is covered with the conductive layer in the minimum coverage or a coverage slightly greater than the minimum coverage, thereby easily securing the bondability between the substrate 200 and the ejection port forming member 300. Typically, the conductive layer made of metal is low in bondability to the ejection port forming member 300 that is made of a resin whereas many components such as the insulating layer 205 and the base 201 are high in bondability to the ejection port forming member 300. Therefore, as an area covered with the conductive layer increases, a contact area between the surfaces of the insulating layer 205 and the base 201 and the reverse (a lower surface in FIG. 3A) of the ejection port forming member 300 decreases by the increased area, so that the ejection port forming member 300 peels off from the substrate 200, thereby increasing the probability of deficient products. In addition, in a case where the conductive layer 206 is excessively enlarged, there easily rises inconvenience that the electric power supply wire 203 or other conductive component parts are short-circuited by the conductive layer.

In view of the above, in the present embodiment, the coverage of the conductive layer 206 is set to a required minimum value based on the minimum coverage obtained according to Formula 1 above. As a consequence, in the present embodiment, the adhesion of the ink mist or the like to the liquid ejecting head due to the electric field produced at the electric power supply wire is suppressed while securing favorable durability and insulating property, to keep the ejection performance of the liquid ejecting head for a long period of time.

Incidentally, the ground wire may be made of any one kind of metal selected from aluminum, gold, silver, copper, and alloys thereof. Moreover, the conductive layer may be made of any one kind of vanadium-based metals and platinum-based metals (tantalum, vanadium, niobium, iridium, platinum, palladium, ruthenium, osmium, and rhodium) or alloys thereof.

Second Embodiment

Next, a second embodiment according to the present invention will be described below. A liquid ejecting head 110 in the second embodiment has the layered structure shown in FIGS. 3A and 3B, and furthermore, a conductive layer 206 has a coverage of 0.85, followed by a print operation under print conditions described below. Printing was performed under the condition where a relative movement speed between the liquid ejecting head 110 and a print medium P was 33 (inch/second). Moreover, a voltage to be applied to an electric power supply wire 203 was 33 (V) under a print condition (a); 24 (V) under a print condition (b); 20 (V) under a print condition (c); and 5 (V) under a print condition (d).

As a result of print operation under the print conditions (a) to (c), the selective adhesion of ink mist to a region facing a formation region of the electric power supply wire 203 was confirmed at an ejection port forming surface 110*a* of the liquid ejecting head 110, thereby inducing deficient ejection as the print operation continued. In contrast, under the condition (d), the adhesion of the ink mist to the region facing the formation region of the electric power supply wire 203 at the ejection port forming surface 110*a* was suppressed, resulting in no deficient ejection that is caused by the adhesion of the ink mist.

Subsequently, the experimental results are discussed.

Figure 5:
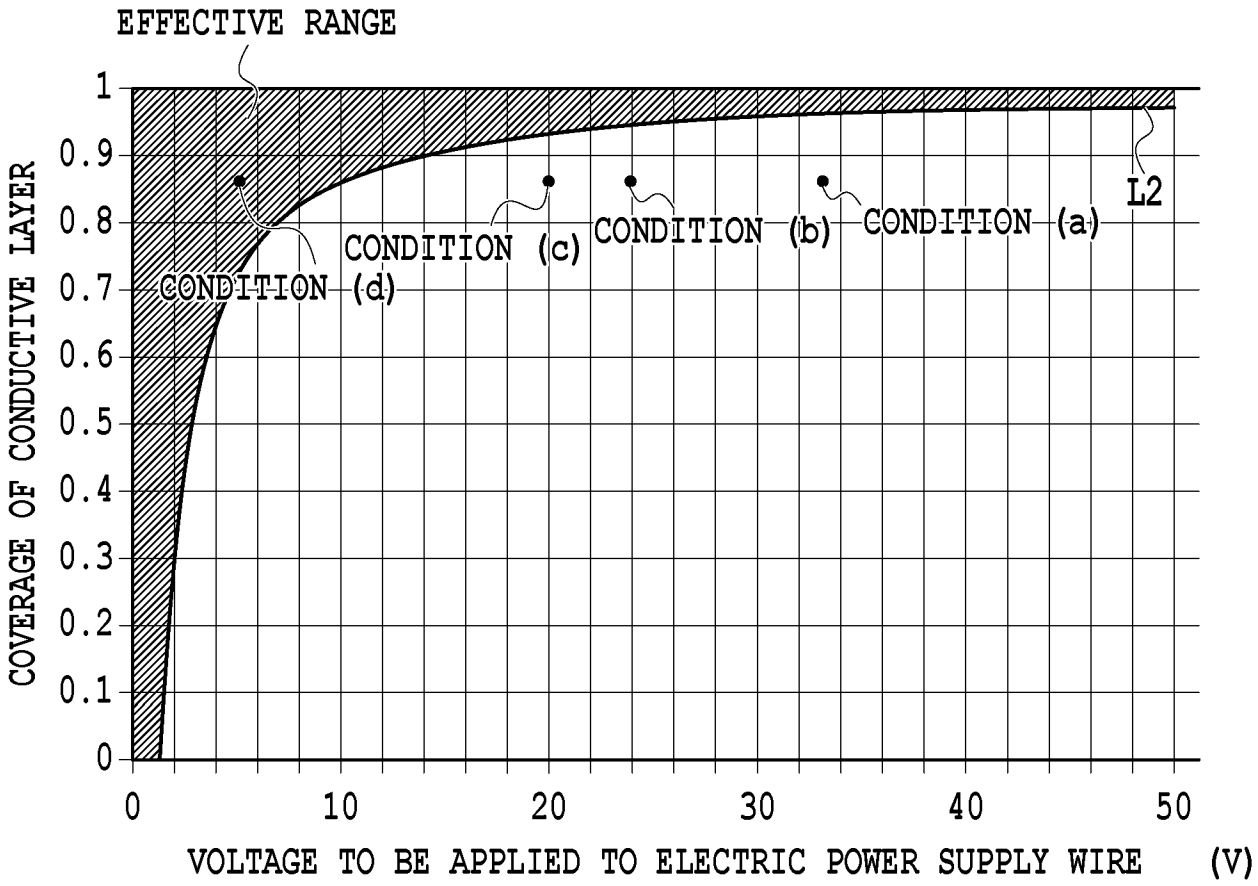
FIG. 5 is a graph illustrating the relationship between a voltage applied to an electric power supply wire and the coverage of a conductive layer in a second embodiment.

FIG. 5 is a graph illustrating the relationship between a voltage to be applied to the electric power supply wire 203 and the coverage of the conductive layer under the print conditions in the second embodiment. In FIG. 5, the print conditions are indicated by (a) to (d). A curve L2 in FIG. 5 indicates an example of the relationship between a "voltage to be applied to electric power supply wire" and a "minimum coverage of conductive layer" obtained according to Formula 1 on the assumption of ink mist having a particle size of 2 (μm) and an electric charge amount of $-5\times10^{-15}$ (C). As illustrated in FIG. 5, the condition (d) falls within a range (a shaded range in FIG. 5) in which an ink adhesion suppression effect with respect to the liquid ejecting head 110 is effective during a print operation: in contrast, the conditions (a) to (c) fall out of the effective range. This accords with the above-described experimental results. Consequently, it can be determined whether or not the adhesion suppression effect of the ink mist or the like can be achieved in the liquid ejecting head 110 by comparing the coverage of the conductive layer with respect to the electric power supply wire 203 with the curve L2.

Third Embodiment

Next, a third embodiment according to the present invention will be described below. Like in the first embodiment, print experiments were carried out under print conditions below by using a liquid ejecting head 110 in which a ratio (a coverage) of a formation region of an electric power supply wire covered with a conductive layer via an insulating layer 205 is 0.85 in the third embodiment.

The print conditions in the third embodiment are as follows: [Experimental Condition I] where a voltage to be applied to an electric power supply wire 203 was 10 (V) and a relative movement speed between the liquid ejecting head 110 and a print medium P was 25 (inch/second); and [Experimental Condition II] where a voltage to be applied to the electric power supply wire 203 was 10 (V) and a relative movement speed between the liquid ejecting head 110 and the print medium P was 40 (inch/second).

As a result of these print experiments, under [Experimental Condition I], it was confirmed that ink mist selectively adhered to a region facing a formation region of the electric power supply wire 203 at an ejection port forming surface 110*a* of the liquid ejecting head 110, thereby inducing deficient ejection as the print operation was continued. In contrast, under [Experimental Condition II], the adhesion of the ink mist with respect to the region facing the formation region of the electric power supply wire 203 at the ejection port forming surface 110*a* could be suppressed, resulting in no deficient ejection that was caused by the adhesion of the ink mist.

Subsequently, the experimental results are discussed.

Figure 6:
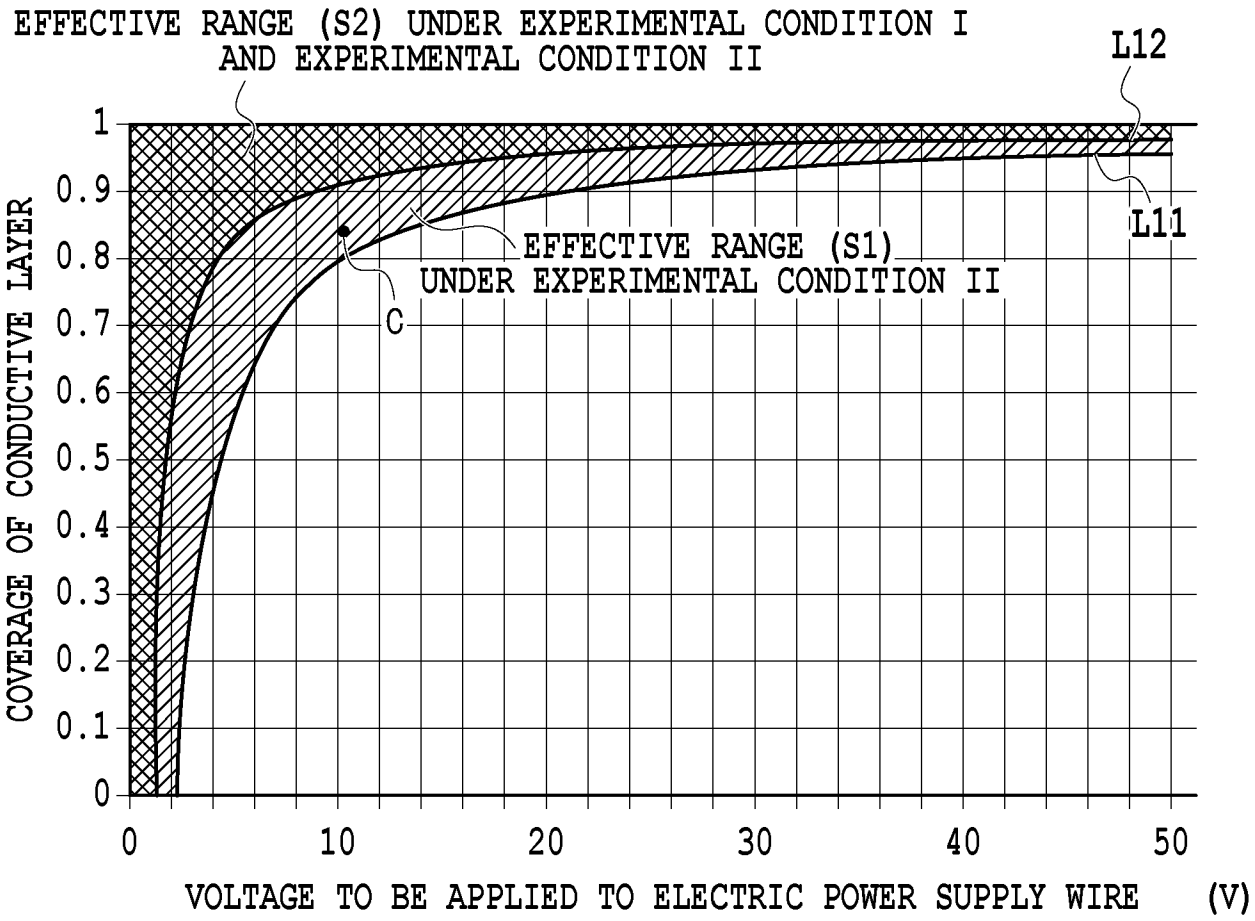
FIG. 6 is a graph illustrating the relationship between a voltage applied to an electric power supply wire and the coverage of a conductive layer in a third embodiment.

FIG. 6 is a graph illustrating the relationship between a "voltage to be applied to electric power supply wire" and a "coverage of conductive layer" under the print conditions in the third embodiment. A curve L11 in FIG. 6 indicates the relationship between the "voltage to be applied to electric power supply wire" and the "minimum coverage of conductive layer" during a print operation under [Experimental Condition I] on the assumption that ink mist has a particle size of 2 (μm) and an electric charge amount of $-5\times10^{-15}$ (C). In addition, a curve L12 in FIG. 6 indicates the relationship between the "voltage to be applied to electric power supply wire" and the "minimum coverage of conductive layer" during a print operation under [Experimental Condition II] on the assumption of similar ink mist. Incidentally, "C" in FIG. 6 indicates an applied voltage (10 (V)) and a coverage (0.85) in the present embodiment.

As illustrated in FIG. 6, under [Experimental Condition II] where the relative movement speed between the liquid ejecting head 110 and the print medium P was 40 (inch/second), effective ranges in which the adhesion suppression effect of the ink mist or the like to the liquid ejecting head 110 is achieved are shaded ranges S1 and S2 above the curve L11. In the meantime, under [Experimental Condition I] where the relative movement speed between the liquid ejecting head 110 and the print medium P was 25 (inch/second), an effective range in which the adhesion suppression effect of the ink mist or the like to the liquid ejecting head 110 is achieved is only a densely shaded range S2 above the curve L12. In this manner, in a case where the relative movement speed between the liquid ejecting head 110 and the print medium P is changed, the adhesion suppression effect of the ink mist or the like changes even in the liquid ejecting head 110 having the same coverage. This accords with the experimental results. Consequently, it can be determined whether or not the adhesion suppression effect of the ink mist or the like can be achieved in the liquid ejecting head 110 by comparing the coverage of the conductive layer with respect to the electric power supply wire 203 with the curve L1 or L2.

Fourth Embodiment

Figure 7:
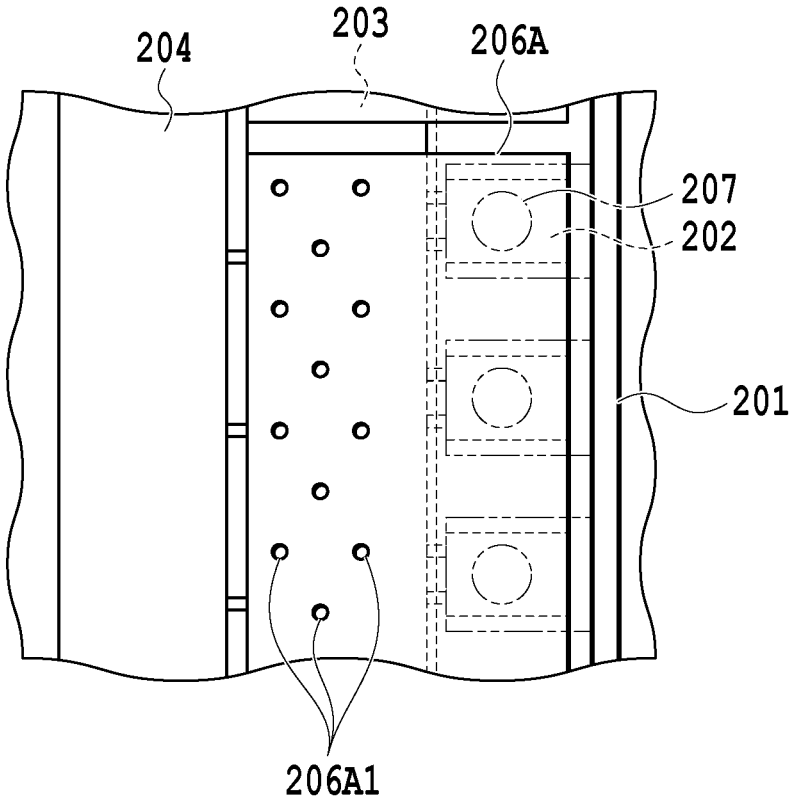
FIG. 7 is a plan view showing the configuration of a first example of a liquid ejecting head in a fourth embodiment.
Figure 8:
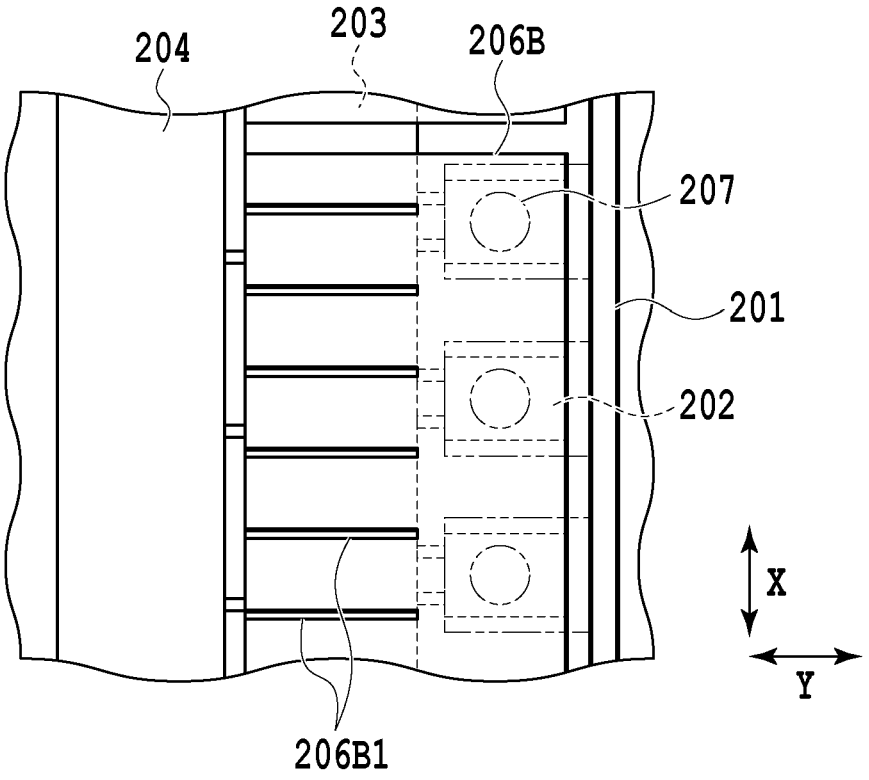
FIG. 8 is a plan view showing the configuration of a second example of a liquid ejecting head in the fourth embodiment.
Figure 9:
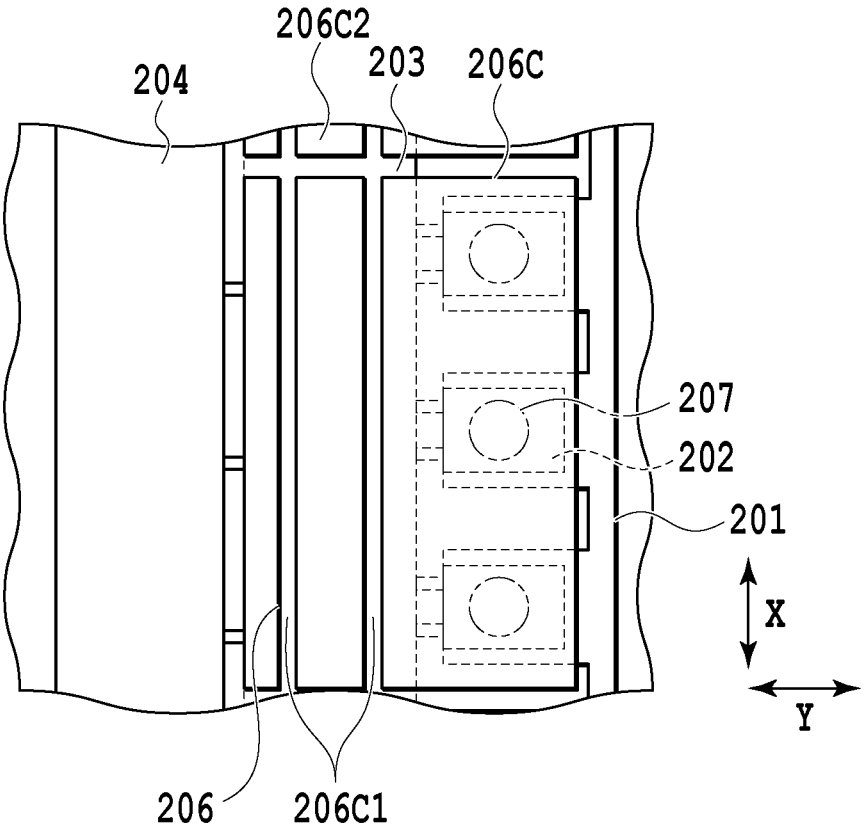
FIG. 9 is a plan view showing the configuration of a third example of a liquid ejecting head in the fourth embodiment.

Next, a description will be given below of a liquid ejecting head in a fourth embodiment according to the present invention by way of three examples (first to third examples) shown in FIGS. 7 to 9, respectively. Here, FIG. 7 shows the first example; FIG. 8, the second example; and FIG. 9, the third example. The examples are identical to each other except that conductive layers that cover a formation region of an electric power supply wire 203 via an insulating layer have different shapes. In FIGS. 7 to 9, in order to clarify the positions of the electric power supply wire 203, a ground wire 204, a heater 202, and the like, an insulating layer covering the electric power supply wire 203, the ground wire 204, and the heater 202 and an ejection port forming member are omitted.

Like in the first embodiment, a conductive layer 206A shown in FIG. 7 covers a region of an insulating layer corresponding to a formation region of the electric power supply wire 203. Here, the conductive layer 206A includes porous non-covering portions 206A1 that partly expose the insulating layer.

Moreover, a conductive layer 206B shown in FIG. 8 includes a plurality of non-covering portions 206B1 that do not cover the insulating layer in a region of the insulating layer facing the formation region of the electric power supply wire 203. The non-covering portions 206B1 shown herein are linear areas extending in a direction (a Y direction) perpendicular to an ejection port array direction (an X direction).

Additionally, a conductive layer 206C shown in FIG. 9 includes a plurality of non-covering portions 206C1 and 206C2 that do not cover the insulating layer 205 corresponding to the formation region of the electric power supply wire 203. Here, the non-covering portions 206C1 extend in an ejection port array direction (an X direction) whereas the non-covering portions 206C2 extend in a Y direction.

As described above, in the fourth embodiment, the non-covering portions without any insulating layer are partly formed in the conductive layer 206A covering the formation region of the electric power supply wire 203 via the insulating layer. Thus, the adjustment of the non-covering portions achieves the adjustment of the coverage of the conductive layer 206C.

With the liquid ejecting heads having the conductive layers 206A, 206B, and 206C, respectively, such formed as described above, print operation experiments were carried out by adjusting the area of the non-covering portion of each of the conductive layers and setting the coverage of the conductive layer with respect to the electric power supply wire 203 in the same manner as the first and second embodiments. As a result, the fourth embodiment also achieved the adhesion suppression effect of the ink mist or the like similar to those achieved in the above-described first and second embodiments. In a case where the bondability between the ejection port forming member and the conductive layer was low, the non-covering portions were formed at the conductive layer, so that the contact area between an ejection port forming member 300 and a substrate 200 was increased, thus achieving the firm bondability therebetween.

Fifth Embodiment

Figure 10:
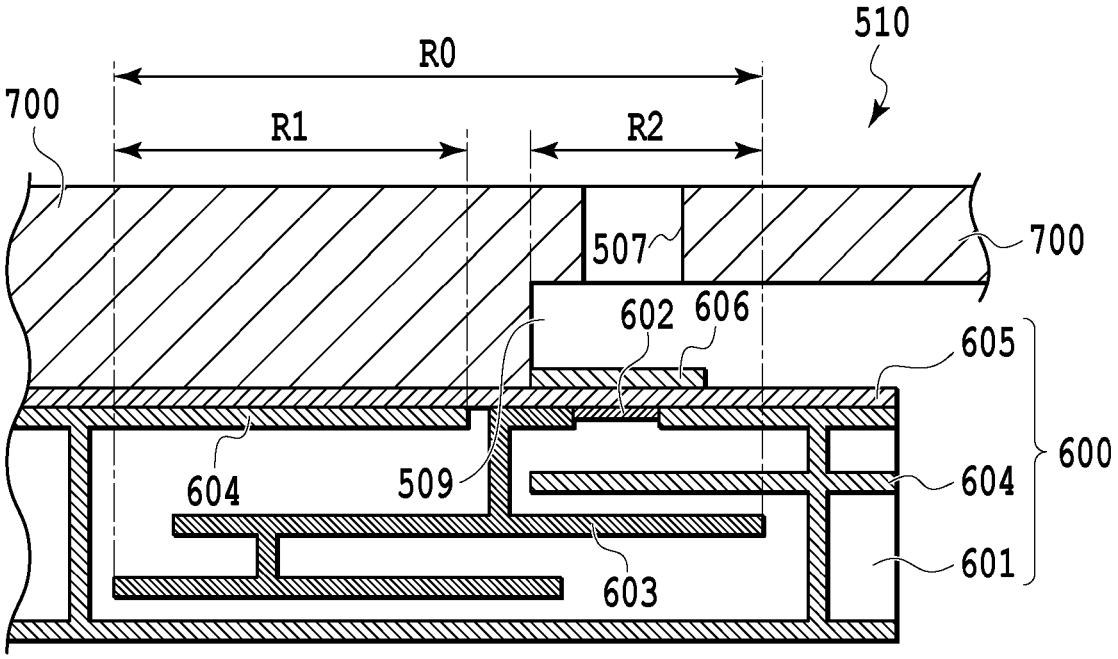
FIG. 10 is a cross-sectional view showing the configuration of a liquid ejecting head in a fifth embodiment.

Next, a fifth embodiment according to the present invention will be described with reference to FIG. 10 that is a cross-sectional view.

A liquid ejecting head 510 in the fifth embodiment is provided with an ejection port forming member 700 that is made of a resin and has an ejection port 507 formed thereat, and a substrate 600 that defines a liquid chamber 509 together with the ejection port forming member 700. The substrate 600 includes a base 601 made of a silicon or the like, a heater 602 formed at the surface (an upper surface in FIG. 10) of the base 601, and an electric power supply wire 603 and a ground wire 604 that are connected to the heater 602. An insulating layer 605 is formed on the base 601 in such a manner as to cover the surface of the base 601, and furthermore, a conductive layer 606 is formed at the surface of the insulating layer 605. The conductive layer 606 is formed on the insulating layer 605 in such a manner as to cover a part of a region facing a planar region having the electric power supply wire 603 formed therein. A coverage in which the conductive layer 606 covers the region facing the electric power supply wire 603 is 0.05. However, in the fifth embodiment, the ground wire 604 formed nearer the surface of the liquid ejecting head 510 than the electric power supply wire 603 covers regions R1 and R2 facing a formation region R0 of the electric power supply wire 603 via the base 601 serving as an insulating layer together with the conductive layer 606.

With the liquid ejecting head 510 in the fifth embodiment, similar experiments were carried out under the print conditions in the first embodiment. Like the "head B" in the first embodiment, the selective adhesion of ink mist to the region facing the region in which the electric power supply wire was formed was suppressed. Consequently, no deficient ejection caused by closing the ejection port 507 with the ink mist adhering to the liquid ejecting head 510 occurred. This signifies that in a case where a layer nearer the liquid ejecting head surface than the electric power supply wire is the ground wire, the ground wire fulfills an effect of the conductive layer.

Sixth Embodiment

In general, the formation of a full color image in an ink jet printing apparatus requires the use of ink of three or more colors such as yellow, cyan, and magenta. As a consequence, a plurality of ejection port arrays, each having a plurality of ejection ports arrayed thereat, are arranged in a liquid ejecting head.

Figure 11:
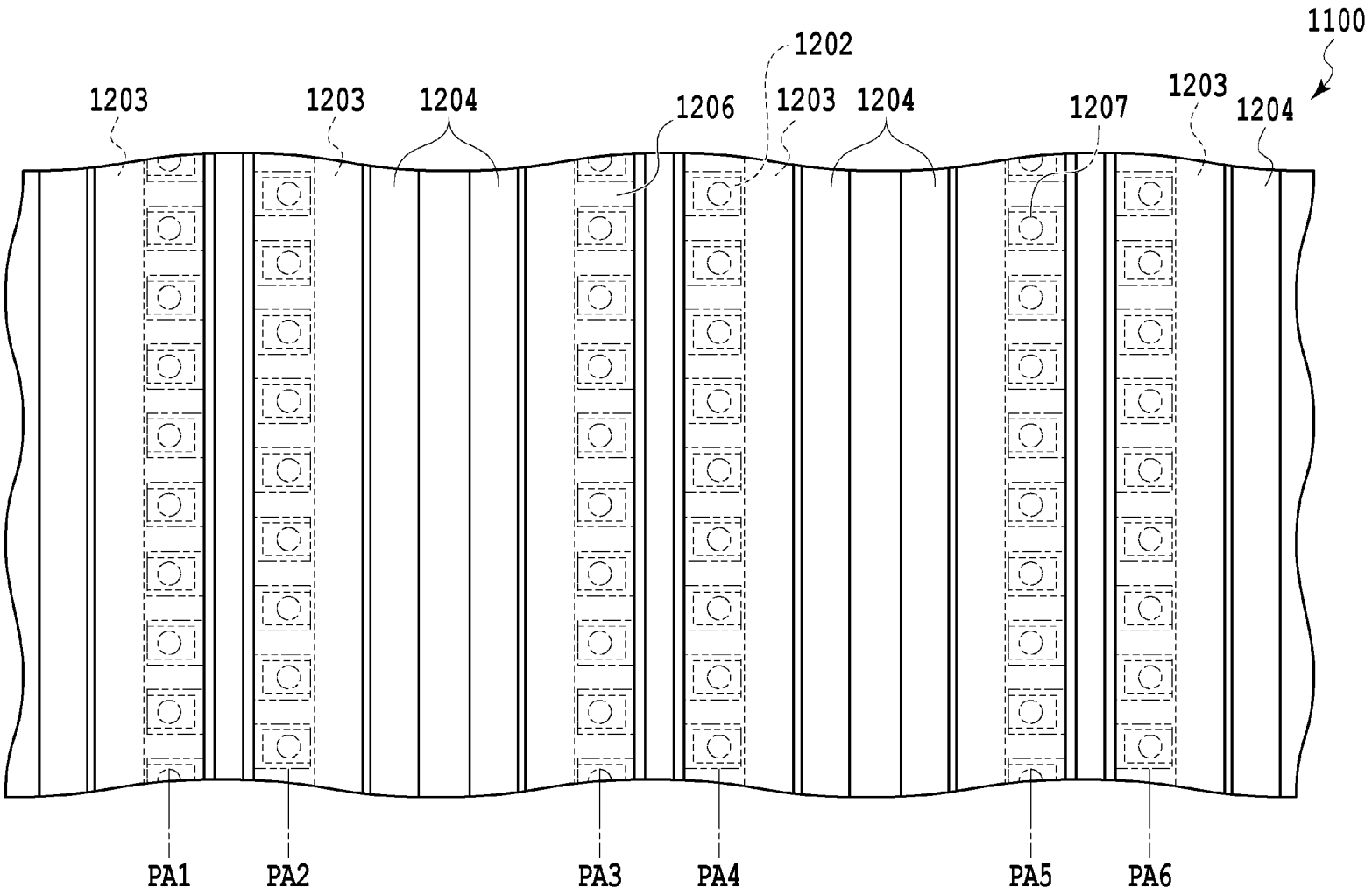
FIG. 11 is a plan view showing the configuration of a liquid ejecting head in a sixth embodiment.

In this sixth embodiment, as shown in FIG. 11, a liquid ejecting head 1100, at which six ejection port arrays PA1 to PA6 in total were arranged by assigning two ejection port arrays to each of three color inks, was fabricated. Moreover, a conductive layer 1206 covered a region in which an electric power supply wire 1203 for supplying electric power to a heater 1202 was disposed at each of ejection ports 1207 at each of the ejection port arrays via an insulating layer, not shown, like in the first embodiment. In FIG. 11, reference numeral 1204 designates a ground wire.

With this liquid ejecting head, experiments similar to those in the first embodiment were carried out. As a result, in a case where the coverage of the conductive layer 1206 falls within the effective range illustrated in FIG. 4, it was possible to suppress the adhesion of ink mist to a region facing a formation region of the electric power supply wire 1203 for supplying the electric power to each of the heaters 1202 at each of the ejection port arrays. Consequently, no deficient ejection caused by closing the ejection port 1207 with the ink mist adhering to the liquid ejecting head 1110 occurred at any ejection port arrays.

Incidentally, in the sixth embodiment, it was confirmed that the present invention was effective also in the liquid ejecting head having the six ejection port arrays. Therefore, it was obvious that the present invention was effective also in the liquid ejecting head having a plurality of ejection port arrays.

Other Embodiments

Although the description was given by way of the elongate liquid ejecting head for use in the ink jet printing apparatus of the full line type in the above-described embodiments, the present invention is applicable to an ink jet printing apparatus using other print systems. For example, the present invention may be applied to a liquid ejecting head for use in an ink jet printing apparatus of a so-called serial type in which the liquid ejecting head is moved in a direction crossing a conveyance direction of a print medium while performing a print operation.

Moreover, although the heater serving as the electrothermal transducer was used as the ejection energy generating element for generating ejection energy for ejecting the ink in the above-described embodiments, a piezoelectric mechanical transducer may be used as the ejection energy generating element.

Additionally, in the above-described embodiments, the region facing the electric power supply wire in the liquid ejecting head was covered via the insulating layer in the coverage calculated according to Formula 1. However, in a case where an object is only to suppress the adhesion of the ink mist or the like due to the electric field produced at the electric power supply wire, the conductive layer may cover the entire region facing the electric power supply wire. Thus, the present invention is not limited to the above-described embodiments.

Furthermore, the conductive layer was formed in such a manner as to cover the electric power supply wire via the insulating layer to achieve the above-described adhesion suppression effect of particles. However, the conductive layer is grounded, thus further stabilizing the potential of the conductive layer, so as to suppress the adhesion of the particles with more certainty.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-007596, filed Jan. 19, 2015, which is hereby incorporated by reference herein in its entirety.

What is claimed is:

1. A liquid ejecting head that ejects liquid through an ejection port, the liquid ejecting head comprising:

an electric power supply wire configured to supply electric power to an ejection energy generating element configured to generate ejection energy for ejecting liquid through the ejection port; and a conductive member configured to cover at least a part of the electric power supply wire with an insulator therebetween, wherein the coverage is determined according to the following formula:

$$\text{coverage} \geq 1-(3\times(D)\times 10^{-18})/|(Q)|\times(U)^2/(V),$$

where U (inch/second) represents a relative movement speed between the ejection port and a print medium; V (V), a voltage applied to the electric power supply wire; D (μm), a size of a particle floating between an ejection port forming surface and the print medium; and Q (C), an electric charge amount possessed by the particle.

2. The liquid ejecting head according to claim 1, wherein the particle is a liquid droplet that does not land on the print medium but floats among liquid droplets to be ejected through the ejection port.

3. The liquid ejecting head according to claim 1, wherein the conductive member covers the ejection energy generating element.

4. The liquid ejecting head according to claim 1, wherein the conductive member is grounded.

5. The liquid ejecting head according to claim 1, wherein a ground wire to be connected to the ejection energy generating element and the electric power supply wire are formed in a base having an insulating property, the ground wire covering the electric power supply wire at a position nearer the ejection port than the electric power supply wire so as to function as the conductive member.

6. The liquid ejecting head according to claim 1, wherein a ground wire to be connected to the ejection energy generating element and the electric power supply wire are formed in a base having an insulating property in such a manner as to form a plurality of layers, the ground wire covering the electric power supply wire at a position nearer the ejection port than the electric power supply wire so as to function as the conductive member.

7. The liquid ejecting head according to claim 1, wherein the conductive member includes a non-covering portion configured not to cover a region in which the power supply wire is formed.

8. The liquid ejecting head according to claim 1, wherein the ground wire is made of any one kind of aluminum, gold, silver, and copper or alloys thereof.

9. The liquid ejecting head according to claim 1, wherein the conductive layer is made of any one kind of vanadium-based metals and platinum-based metals (tantalum, vanadium, niobium, iridium, platinum, palladium, ruthenium, osmium, and rhodium) or alloys thereof.

* * * * *